US009400125B2

(12) United States Patent
Hoos

(10) Patent No.: US 9,400,125 B2
(45) Date of Patent: Jul. 26, 2016

(54) PROCESS AND APPARATUS FOR TRANSFERRING HEAT FROM A FIRST MEDIUM TO A SECOND MEDIUM

(75) Inventor: Frank Hoos, Mijnsheerenland (NL)

(73) Assignee: Heleos Technology GmbH, Zug (CH)

( * ) Notice: Subject to any disclaimer, the term of this patent is extended or adjusted under 35 U.S.C. 154(b) by 633 days.

(21) Appl. No.: 13/001,901

(22) PCT Filed: Jul. 3, 2009

(86) PCT No.: PCT/EP2009/058426

§ 371 (c)(1),
(2), (4) Date: Feb. 4, 2011

(87) PCT Pub. No.: WO2010/000840

PCT Pub. Date: Jan. 7, 2010

(65) Prior Publication Data

US 2011/0146951 A1 Jun. 23, 2011

(30) Foreign Application Priority Data

Jul. 4, 2008 (EP) ..... 08159760
Jul. 23, 2008 (EP) ..... 08160942

(51) Int. Cl.
*F25D 9/00* (2006.01)
*F25B 3/00* (2006.01)

(52) U.S. Cl.
CPC ..... *F25B 3/00* (2013.01)

(58) Field of Classification Search
CPC ..... F25B 3/00
USPC ..... 62/401, 402, 116, 87, 115; 165/86, 87; 492/46; 416/96; 415/1, 115, 175
See application file for complete search history.

(56) References Cited

U.S. PATENT DOCUMENTS 3,470,704 A * 10/1969 Kantor ..... 62/115
3,828,573 A 8/1974 Eskeli
3,902,549 A 9/1975 Opfermann
3,926,010 A 12/1975 Eskeli
3,931,713 A 1/1976 Eskeli
3,933,008 A 1/1976 Eskeli
3,962,888 A * 6/1976 Eskeli ..... 62/499

(Continued)

FOREIGN PATENT DOCUMENTS

DE 3238567 4/1984
GB 1575684 9/1980

(Continued)

OTHER PUBLICATIONS

Communication providing the relevance of JPS54-24346.

*Primary Examiner* — Marc Norman
*Assistant Examiner* — Ana Vazquez
(74) *Attorney, Agent, or Firm* — Mendelsohn Dunleavy, P.C.

(57) ABSTRACT

The invention relates to a process and apparatus (1) for transferring heat from a first relatively cold medium to a second relatively hot medium, comprising a gastight rotor (4) rotatably mounted in a frame (2), and, mounted inside the rotor (4), a compressor (10), a first heat exchanger (8) for transferring heat from the fluid to the second medium and located relatively far from the axis of rotation of the rotor (4), an expansion chamber (11) for expanding the fluid, and a channel (14) for conveying the expanded fluid from the expansion chamber (11) to the compressor (10), wherein the first heat exchanger (8) is thermally insulated from the channel (14).

21 Claims, 3 Drawing Sheets

(56) References Cited

U.S. PATENT DOCUMENTS

| | | | | | |
|---|---|---|---|---|---|
| 3,981,702 | A | | 9/1976 | Eskeli | |
| 4,005,587 | A | | 2/1977 | Eskeli | |
| 4,023,366 | A | * | 5/1977 | Schneider | 60/671 |
| 4,047,392 | A | * | 9/1977 | Eskeli | 62/402 |
| 4,060,989 | A | | 12/1977 | Eskeli | |
| 4,107,944 | A | | 8/1978 | Eskeli | |
| 4,285,202 | A | | 8/1981 | Bailly Du Bois | |
| 4,438,638 | A | * | 3/1984 | Hays et al. | 62/500 |
| 4,864,826 | A | * | 9/1989 | Lagow | 60/670 |
| 5,097,677 | A | * | 3/1992 | Holtzapple | 62/500 |
| 5,709,103 | A | * | 1/1998 | Williams | 62/402 |
| 7,818,977 | B2 | * | 10/2010 | Retolaza et al. | 62/476 |
| 7,818,978 | B2 | * | 10/2010 | Ducoulombier et al. | 62/513 |
| 8,033,135 | B2 | * | 10/2011 | Okaichi et al. | 62/468 |
| 2003/0070442 | A1 | * | 4/2003 | Adaniya et al. | 62/228.1 |
| 2005/0061028 | A1 | * | 3/2005 | Mennie et al. | 62/601 |
| 2006/0218919 | A1 | * | 10/2006 | Mitani et al. | 60/519 |
| 2008/0247897 | A1 | * | 10/2008 | Guthrie | 418/229 |

FOREIGN PATENT DOCUMENTS

| | | | |
|---|---|---|---|
| JP | S5424346 | A | 2/1979 |
| JP | 58035388 | | 3/1983 |
| JP | 61165590 | | 7/1986 |
| WO | 03095920 | | 11/2003 |
| WO | 2006119946 | | 11/2006 |
| WO | WO2010000840 | A1 | 1/2010 |

* cited by examiner

PROCESS AND APPARATUS FOR TRANSFERRING HEAT FROM A FIRST MEDIUM TO A SECOND MEDIUM

The invention relates to a process and an apparatus for transferring heat from a first, relatively cold medium to a second, relatively hot medium.

U.S. Pat. No. 4,107,944 relates to a method and apparatus for generating heating and cooling by circulating a working fluid within passageways carried by rotors, compressing said working fluid therewithin and removing heat from said working fluid in a heat removal heat exchanger and adding heat into said working fluid in a heat addition heat exchanger, all carried by said rotors. The working fluid is sealed within, and may be a suitable gas, such as nitrogen. A working fluid heat exchanger is also provided to exchange heat within the rotor between two streams of said working fluid.

U.S. Pat. No. 4,005,587 relates to a method and apparatus for transport of heat from a low temperature heat source into a higher temperature heated sink, using a compressible working fluid compressed by centrifugal force within a rotating rotor with an accompanying temperature increase. Heat is transferred from the heated working fluid into the heat sink at higher temperature, and heat is added into the working fluid after expansion and cooling from a colder heat source. Cooling is provided within the rotor to control the working fluid density, to assist working fluid circulation.

Similar methods and apparatuses are known from U.S. Pat. Nos. 3,828,573, 3,933,008, 4,060,989, and 3,931,713.

It is an object of the present invention to provide a process for efficiently generating a high temperature medium and/or a low temperature medium.

To this end, the process according to the present invention involves rotating a contained amount of a compressible fluid about an axis of rotation, compressing the fluid in a direction away from the axis of rotation, transferring heat from the compressed fluid to the second, relatively hot medium, expanding the fluid in a direction towards the axis of rotation, transferring heat from the first medium to the fluid, while at least substantially preventing heat transfer between the expanded fluid and the compressed fluid.

In one aspect, heat is transferred from the first medium to the fluid during expansion.

In a further aspect, the fluid is compressed at least substantially isentropically and/or expanded at least substantially isothermically.

In yet a further aspect, heat is transferred from the compressed fluid to the second, relatively hot medium, at least substantially isobarically, i.e. the pressure in the fluid remains at least substantially constant during heat transfer.

In a further aspect, the fluid is heated after expansion and prior to compression. Adding heat at this stage reduces the amount of work to be fed to the rotor relative to the amount of heat transferred from the compressed fluid to the second medium.

In a further aspect, the process includes generating work in a heat conversion cycle, e.g. employing a Sterling engine, by means of heat contained in the second medium.

At least part of the work generated can be employed to rotate the contained amount of fluid. Also, at least part of the residual heat of the heat conversion cycle can be employed to heat the fluid after expansion and prior to compression. Thus, a combined process is obtained having an increased ratio of work generated and heat inputted.

In a further aspect, the process is employed to provide cooling, e.g. in an air-conditioning system, and heat is transferred from the fluid to a relatively hot medium during compression and to the fluid after during or after expansion and prior to compression.

The process according to the present invention enables generating heat, cold and/or work at a relatively high efficiency.

The process according to the present invention can be operated at least partially by means of a medium taken from the surrounding and/or having a temperature at least substantially equal to that of the surroundings.

The hot and cold media obtained with the invention in turn can be employed e.g. for heating or cooling buildings or, on a larger scale, for generating electricity by means of e.g. a Carnot cycle or "steam cycle".

The invention further relates to an apparatus for transferring heat from a first, relatively cold medium to a second, relatively hot medium, comprising a gastight rotor rotatably mounted in a frame, and, mounted inside the rotor, a compressor, a first heat exchanger for transferring heat from the fluid to the second medium and located relatively far from the axis of rotation of the rotor, an expansion chamber for expanding the fluid, and a channel for conveying the expanded fluid from the expansion chamber to the compressor, wherein the first heat exchanger is thermally insulated from the channel.

In one aspect, the apparatus comprises a second heat exchanger, which is thermally coupled to or forms part of the expansion chamber.

In a further aspect, the first heat exchanger is adapted to transfer heat from the compressed fluid to the second, relatively hot medium, at least substantially isobarically. To that end, in one embodiment, the first heat exchanger extends parallel to the axis of rotation of the gastight rotor, i.e. at an at least substantially constant distance from said axis, thus avoiding or reducing fluctuations in the potential energy and hence in the pressure of the fluid. In one aspect, the cross-sectional area and shape of the heat exchanger are constant over most or all of its length.

In a further aspect, at least one of the heat exchangers is coupled to a heating system and/or an air-conditioning system of a building, such as a house or office.

In a further aspect, typically when the invention is applied on an industrial scale, at least one of the heat exchangers is coupled to a cycle for generating work. This cycle can comprise an evaporator or super-heater, which is thermally coupled to the high temperature heat exchanger, a condenser, thermally coupled to the low temperature heat exchanger, and a heat engine. The environment will typically serve as a heat sink, but may also serve a high temperature source, if the operating temperature of the cycle is sufficiently low.

In yet a further aspect, the compressible fluid is a gas and e.g. contains or consists essentially of a mono-atomic element having an atomic number (Z)≥18, such as Argon, or ≥36, such as Krypton and Xenon.

In accordance with at least some aspects of the present invention, artificial gravity is employed to reduce the length of the column of the compressible fluid, in comparison with a column subjected merely to the gravity of the earth, and the atmosphere is replaced by a gas allowing a much higher temperature gradient in the fluid. Mixing can be employed to improve heat conduction within the fluid.

Within the framework of the present invention the term "gradient" is defined as a continuous or stepwise increase or decrease in the magnitude of a property observed in passing from one point to another, e.g. along a radius of a cylinder. Also, the term "compressor" includes any impeller for increasing the density of the fluid.

For the sake of completeness, it is noted that DE 32 38 567 relates to a device for generating temperature differences for heating and cooling. Under the influence of an external force, a temperature difference is established in a gas. By using centrifugal forces and with gases of high molecular weight, this effect is increased to such an extent that it is of interest for technical use.

WO 03/095920 relates to a method for transmitting heat energy, wherein the heat energy is transmitted into an inner chamber (3) of a rotating centrifuge via a first heat exchanger (4,4*a*,4*b*), in which inner chamber (3) a gaseous energy transfer medium is provided, and wherein the heat is discharged from the centrifuge (2) via a second heat exchanger (5; 5*a*, 5*b*). The amount of energy used can be reduced substantially by providing the gaseous energy transmission medium inside the rotor (12) in a state of equilibrium and by radially orienting the heat flow in an outward direction. It is essential to the invention underlying WO 03/095920 that convection be prevented (page 2, last sentence).

U.S. Pat. No. 3,902,549 relates to a rotor mounted for high-speed rotation. At its center is located a source of thermal energy whereas at its periphery there is located a heat exchanger. Chambers are provided, accommodating a gaseous material which, depending upon its position in the chambers, can receive heat from the source of thermal energy or yield heat to the heat exchanger.

WO 2006/119946 relates to device (70) and method for transferring heat from a first zone (71) to a second zone (72) using mobile (often gaseous or vaporous) atoms or molecules (4) in which in one embodiment, the chaotic motion of the atoms/molecules which usually frustrates the transfer of heat by simple molecular motion is overcome by using preferably elongated nanosized constraints (33) (such as a carbon nanotube) to align the atoms/molecules and then subjecting them to an accelerating force in the direction in which the heat is to be transferred. The accelerating force is preferably centripetal. In an alternative embodiment, molecules (4*c*) in a nanosized constraint may be arranged to transfer heat by means of an oscillation transverse of the elongation of an elongated constraint (40).

JP 61165590 and JP 58035388 relate to rotary-type heat pipes. U.S. Pat. No. 4,285,202 relates to industrial processes for energy conversion involving at least one step which consists in acting on the presence of a working fluid in such a manner as to produce either compression or expansion.

The invention will now be explained in more detail with reference to the Figures, which schematically show cross-sections of apparatuses according to the present invention suitable for small scale applications, in this example for heating and/or cooling a house.

Figure 1:
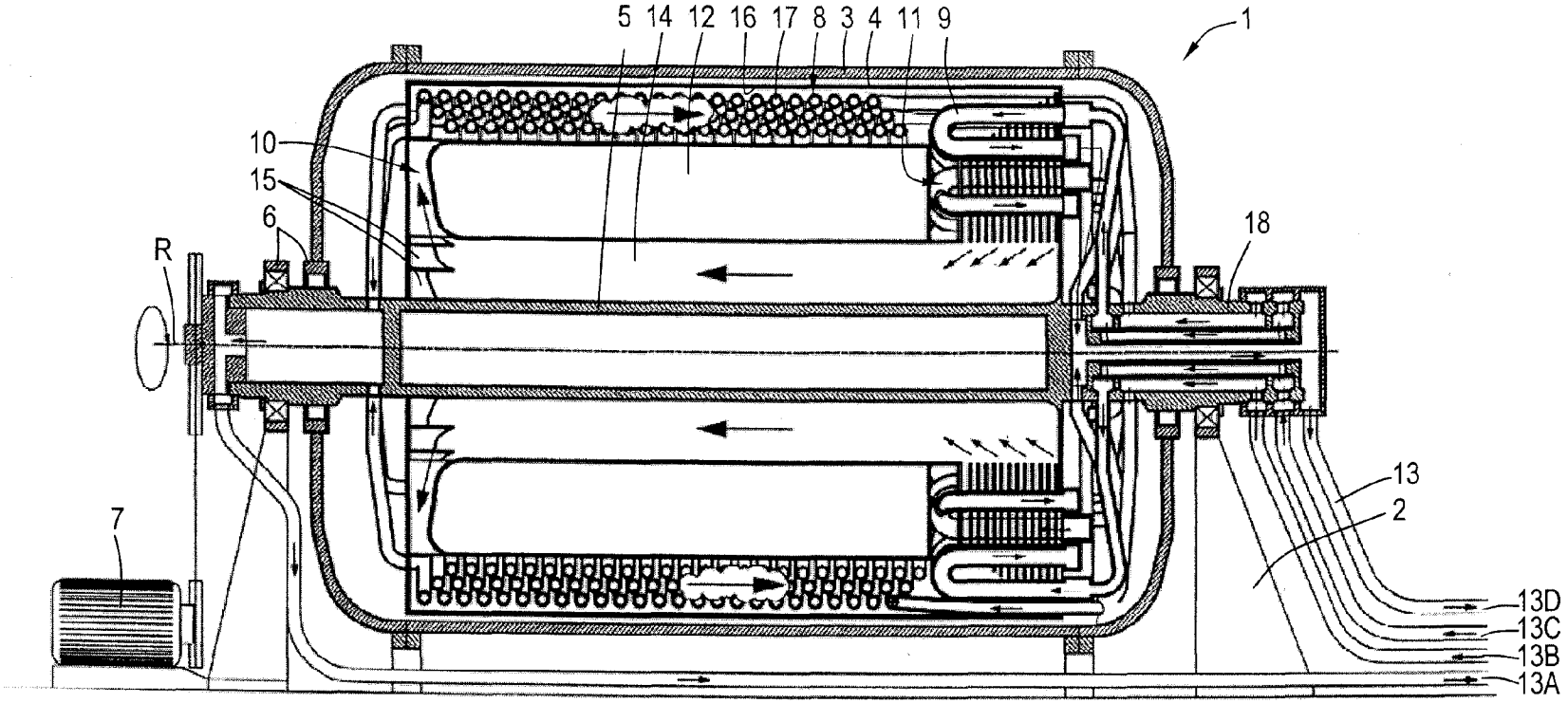
FIG. 1 shows a cross-section of a first apparatus according to the present invention suitable for small scale applications, in this example for heating and/or cooling a house.

The apparatus 1 shown in FIG. 1 comprises a static base frame 2, firmly positioned on a floor, an airtight outer casing 3 fixedly mounted on the frame 2, and a rotor 4, mounted inside the casing 3 and in the base frame 2, e.g. by means of a hollow axle 5 and suitable bearings, such as ball bearings 6. The bearings can be located outside the outer casing, so as to facilitate maintenance and replacement.

The rotor 4 has a diameter in a range from 30 to 100 centimeters, in this example 50 cm. The wall of the rotor 4 is thermally insulated in a manner known in itself. The apparatus 1 further comprises a driving means, in this example an electric motor 7 to spin the rotor at rates in a range from 1500 to 9000 RPM. Losses can be reduced by lowering the pressure in the outer casing 3, e.g. to a vacuum.

The rotor 4 contains two heat exchangers 8, 9, a compressor 10, an expansion chamber 11, a thermal insulator 12, and conduits 13 for supplying liquids.

The thermal insulator 12 comprises an annular hollow body, extending coaxial with the axle 5. To enhance insulation, the annular body may contain an insulating material or a vacuum. The thermal insulator 12 and the axle 5 define a first annular and coaxial chamber 14, establishing fluid connection between the outlet of the expansion chamber 11 and the inlet of the compressor 10.

The compressor 10 comprises a plurality of vanes 15 and is delimited by an end wall of the rotor 4 and a curved end wall of the thermal insulator 12.

The thermal insulator 12 and the inner wall of the rotor 4 define a second annular and coaxial chamber 16, establishing fluid connection between the outlet of the compressor 10 and the inlet of the expansion chamber 11. One of the heat exchangers 8 is mounted inside this second chamber 16. In this example, the heat exchanger 8 comprises a coiled tube 17 coaxial with the axis of rotation (R) of the rotor 4 and is connected via rotatable fluid couplings 18 to a supply 13A and to an outlet 13B.

The expansion chamber 11 comprises a plurality of vanes (not shown) and thus functions as a turbine. The other one of the heat exchangers 9 is integrated in the expansion chamber 11 and is connected via rotatable fluid couplings to a supply 13C and to an outlet 13D.

In this example, the rotor 4 is filled with Xenon at a pressure of 6 bar (at ambient temperature and when the rotor is not rotating).

Rotating the rotor 4 will generate a radial temperature gradient in the fluid, with a temperature difference ($\Delta T$) in a range from 10 to 200° C., depending on the angular velocity of the rotor 4. The gradient is amplified by substantially isentropic compression in the compressor 10, which also generates or sustains circulation of the fluid inside the rotor.

Other ways to generate or reinforce circulation in the process and apparatus of the present invention include, one or more axial fans located, e.g., in the channel for conveying the expanded fluid from the expansion chamber to the compressor;

employing a compressor that comprises at least two stages, typically co-axial sub-rotors, one stage coupled to the same axis as the expansion chamber, pre-heating the relatively cold first medium, e.g. by means of one or more Peltier-elements.

The relatively hot compressed fluid flows through the second annular chamber 16 transferring heat to the medium in the heat exchanger 8. In this example, the medium is water flowing in counter-current through the heat exchanger 8. The heated water can be employed for central heating of a house.

After transferring heat, the fluid is expanded from the circumference of the rotor 4 towards the axis of rotation, causing the temperature to drop below ambient temperature. During expansion, the fluid is heated by means of the heat exchanger 9 in the expansion chamber 11 and a medium at ambient temperature, e.g. water taken from the surroundings, or a medium at a higher temperature, such as exhaust gasses from another apparatus.

Finally, the expanded fluid flows through the first annular chamber 14 to the inlet of the compressor 10. Additional heat can be transferred to the fluid from, e.g. a medium flowing through the hollow axle 5. In an alternative example, at least one electric motor(s) for driving the rotor is mounted inside the axle, such that heat dissipated in this motor is transferred to the fluid. Regenerative heat transfer between the compressed fluid and the expanded fluid is substantially prevented by the thermal insulator.

The process and apparatus according to the present invention enable generating heat, cold and/or work at a relatively high efficiency.

In a further embodiment, the compressor comprises a rotor that can rotate at a higher angular velocity than the main rotor. In this embodiment, the average angular velocity of the rotors, both rotating, determines the differential temperature, i.e. the temperature of the heated medium, such as water for central heating, increases when the average angular velocity is increased. The difference between the speeds of the rotors determines the heat output of the apparatus. Thus, it is possible e.g. to generate a high output of heat at a relatively low temperature. In general, efficiency is higher if the temperature of the (relatively hot) medium leaving the apparatus is at a temperature that corresponds to the temperature required by the application, e.g. central heating.

Figure 2:
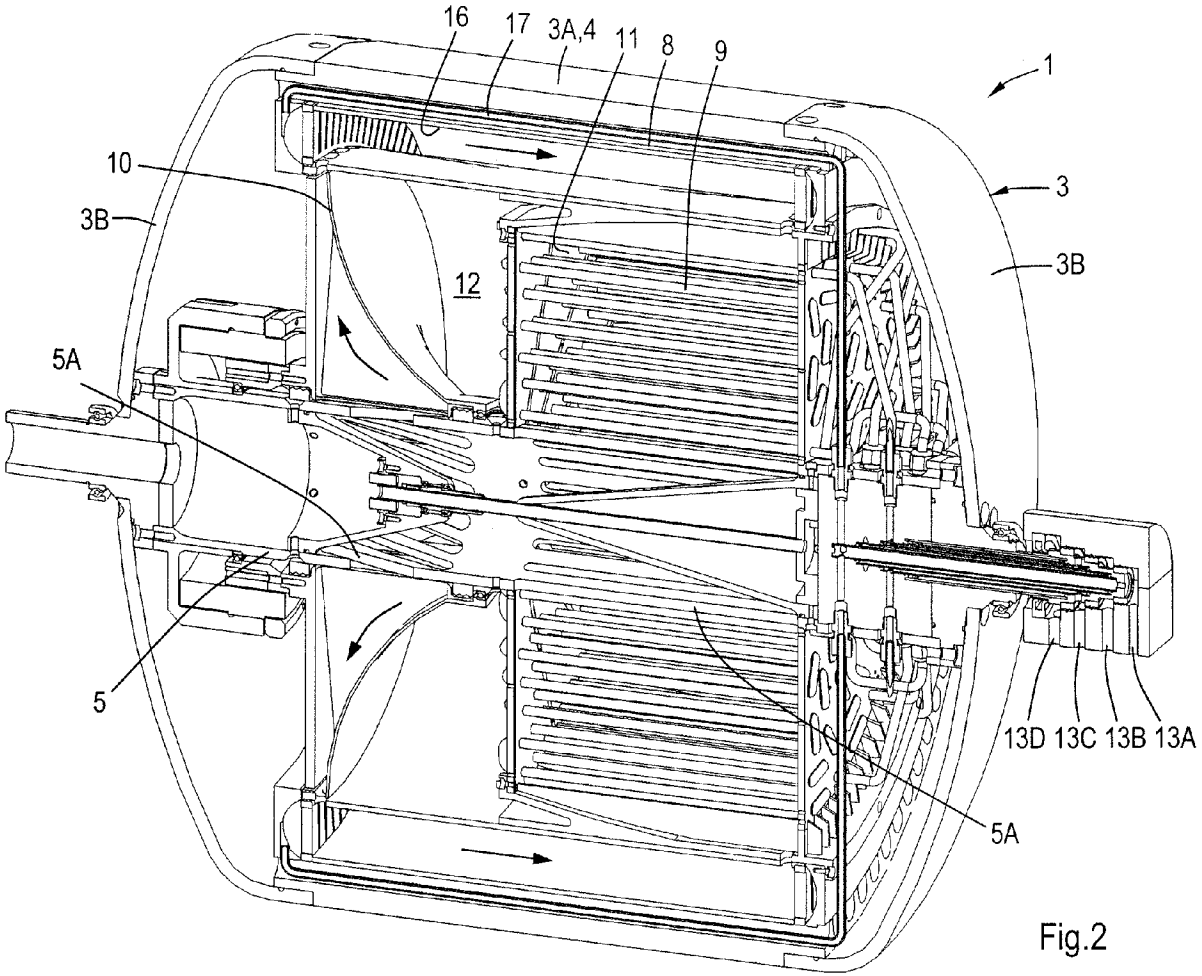
FIG. 2 shows a cross-section of a first apparatus according to the present invention comprising a compressor that can be driven independently with respect to the gastight rotor.

An example of this embodiment is shown in FIG. 2. The following explanation will focus on the differences with the embodiment shown in FIG. 1.

The outer casing 3 of the apparatus 1 shown in FIG. 2 comprises an outer casing 3 in turn comprising a central section 3A made of a thermally insulating material, e.g. a fiber reinforced polymer, and end shells 3B made of a metal, e.g. aluminum. The casing 3 is rotatably mounted in a frame (not shown) by means of an axle 5 and has a diameter of for example 55 cm. The rotor 4 is an integral part of the central section 3A of the outer casing 3 and contains two heat exchangers 8, 9, a compressor 10, an expansion chamber 11, a thermal insulator 12, and conduits 13 for supplying liquids.

The thermal insulator 12 comprises an annular hollow body, extending coaxially with the axle 5. To enhance insulation, the annular body may contain an insulating material. The axle 5 is hollow and establishes, by means of slits 5A in its wall, a fluid connection between the outlet of the expansion chamber 11 and the inlet of the compressor 10. The compressor 10 is rotatably mounted on the axle 5, comprises a plurality of vanes 15 and is delimited by an end wall of the rotor 4.

An coaxial chamber 16, defined in the central section 3A, establishes a fluid connection between the outlet of the compressor 10 and the inlet of the expansion chamber 11. The cross-sectional area and annular shape of the co-axial chamber are constant over its length. One of the heat exchangers 8 envelopes this second chamber 16. In this example, the heat exchanger 8 comprises a plurality of axially extending tubes 17 for counter-current heat exchange with the fluid in the coaxial chamber 16 and thermally insulated return tubes (not shown) connected via rotatable fluid couplings to a supply 13A and to an outlet 13B, respectively.

The expansion chamber 11 comprises a plurality of vanes (not shown) and thus functions as a turbine. The other one of the heat exchangers 9 is integrated in the expansion chamber 11 and is connected via rotatable fluid couplings to a supply 13C and to an outlet 13D.

In this example, the rotor 4 is filled with Argon at a pressure of 10 bar (at ambient temperature and when the rotor is not rotating).

Figure 3A:
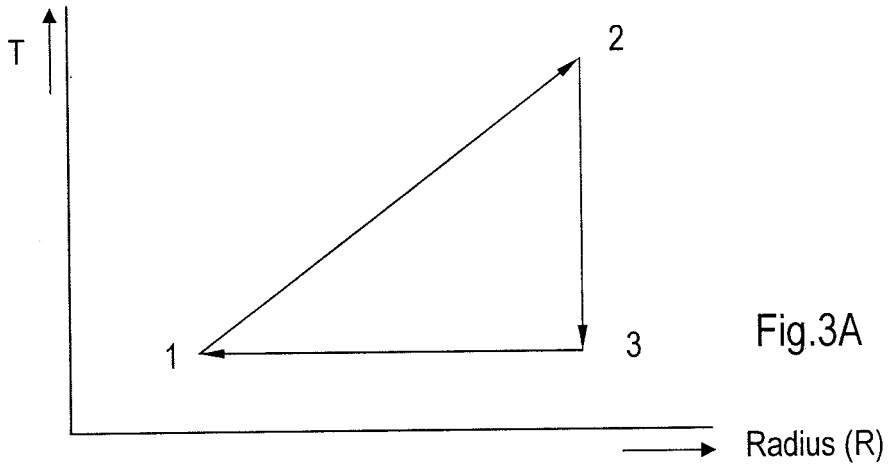
FIGS. 3A and 3B are diagrams of the process according to the present invention.
Figure 3B:
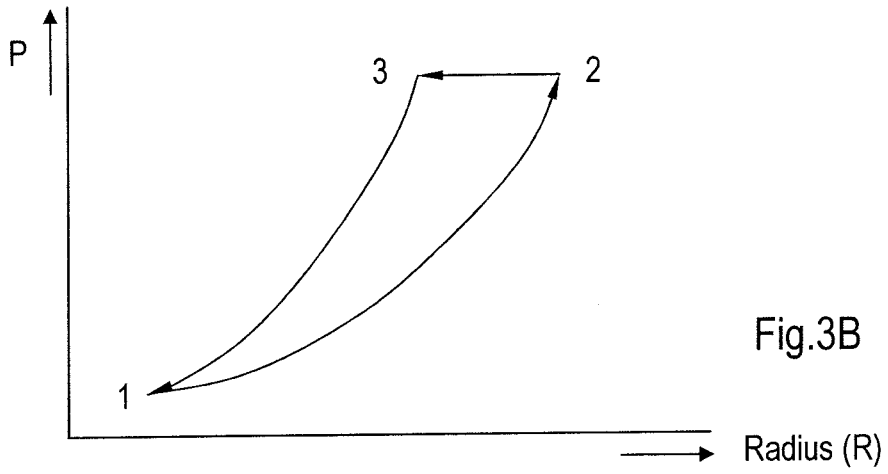

The cycle of this apparatus is shown in FIGS. 3A and 3B and comprises isentropic compression (1-2) by means of the compressor (10), isobaric heat transfer (2-3) in the second chamber (16), and isothermal expansion (3-1) in the expansion chamber (11).

In another embodiment, the apparatus according to the present invention is arranged primarily to provide cooling, e.g. in an air-conditioning system, and the circulation of the fluid is reversed. Heat is transferred from the fluid to a relatively hot medium during compression of the fluid, e.g. by means of a heat exchanger (9) in the compression chamber (11), and to the fluid during or after expansion and prior to compression, e.g. by means of a heat exchanger (not shown in the Figures) in or about the axle (5) of the apparatus and connected to a medium that is to be cooled.

In yet another embodiment, the apparatus comprises two or more rotors coupled in series or in parallel. For instance, in configurations comprising two rotors in series, the heated medium from the first rotor is fed to the low temperature heat exchanger of the second rotor. As a result, heat transfer to the high temperature heat exchanger in the second rotor is increased considerably, when compared to heat transfer in the first rotor. The cooled medium from the first rotor can be used as a coolant, e.g. in a air conditioner.

The invention is not restricted to the above-described embodiments, which can be varied in a number of ways within the scope of the claims. For instance, other media, such as carbon dioxide, hydrogen, and $CF_4$, can be used in the heat exchangers in the rotor.

The invention claimed is:

1. A process for transferring heat from a first medium to a second medium, the process comprising:

(a) rotating a compressible fluid about an axis of rotation such that the fluid is compressed in a direction away from the axis of rotation to provide a compressed fluid;

(b) transferring heat from the compressed fluid to the second medium;

(c) expanding the compressed fluid in a direction towards the axis of rotation to (i) provide an expanded fluid and (ii) transfer heat from the first medium to the fluid; and (d) conveying the expanded fluid towards the compression of step (a) while preventing heat transfer between the expanded fluid of step (d) and the compressed fluid of step (b).

2. The process of claim 1, wherein:

the fluid compression of step (a) is isentropic compression;

the heat transfer of step (b) is isobaric heat transfer; and the fluid expansion of step (c) is isothermal expansion.

3. The process of claim 2, wherein the process has a thermodynamic cycle consisting of the isentropic compression, followed by the isobaric heat transfer, followed by the isothermal expansion.

4. The process of claim 2, wherein:

the first medium is taken from the surroundings and/or has a temperature equal to that of the surroundings;

the fluid compression of step (a) and the fluid expansion of step (c) are provided by separate impellers rotating at different rates; and the fluid comprises a mono-atomic element having an atomic number (Z)≥18.

5. The process of claim 1, wherein the first medium is taken from the surroundings and/or has a temperature equal to that of the surroundings.

6. The process of claim 1, wherein the fluid compression of step (a) and the fluid expansion of step (c) are provided by separate impellers rotating at different rates.

7. The process of claim 1, wherein the fluid comprises a mono-atomic element having an atomic number (Z)≥18.

8. The process of claim 7, wherein the mono-atomic element has an atomic number (Z)≥36.

9. The process of claim 1, wherein the fluid consists of a mono-atomic element having an atomic number (Z)≥18.

10. The process of claim 9, wherein the mono-atomic element has an atomic number (Z)≥36.

11. The process of claim 1, further comprising transferring additional heat to the expanded fluid after step (c) and before the expanded fluid is compressed after step (d).

12. An apparatus for transferring heat from a first medium to a second medium, the apparatus comprising:

a frame; and a first rotor rotatably mounted to the frame, the first rotor comprising:

a compressor having (i) an inlet and (ii) an outlet;

a first heat exchanger having (i) an inlet fluidly connected to the outlet of the compressor and (ii) an outlet;

an expansion chamber having (i) an inlet fluidly connected to the outlet of the first heat exchanger and (ii) an outlet;

a channel having (i) an inlet fluidly connected to the outlet of the expansion chamber and (ii) an outlet fluidly connected to the inlet of the compressor; and a thermal insulator located between the channel and the first heat exchanger, wherein, during operation of the apparatus, the first rotor rotates about an axis of rotation with respect to the frame, such that:

within the compressor, compressible fluid received from the channel is compressed;

within the first heat exchanger, heat flows from fluid received from the compressor to the second medium;

within the expansion chamber, fluid received from the first heat exchanger expands and heat flows from the first medium to the fluid; and the thermal insulator prevents heat transfer between fluid in the channel and fluid in the first heat exchanger.

13. The apparatus of claim 12, wherein:

fluid compression in the compressor is isentropic compression;

heat transfer in the first heat exchanger is isobaric heat transfer; and fluid expansion in the expansion chamber is isothermal expansion.

14. The apparatus of claim 13, wherein the operation of the apparatus has a thermodynamic cycle consisting of the isentropic compression in the compressor, followed by the isobaric heat transfer in the first heat exchanger, followed by the isothermal expansion in the expansion chamber.

15. The apparatus of claim 14, wherein:

the first heat exchanger extends parallel to the axis of rotation of the first rotor;

the compressor comprises a second rotor that can rotate relative to the first rotor; and the apparatus further comprises at least one motor that rotates at least one of (i) the first rotor with respect to the frame and (ii) the second rotor with respect to the first rotor, wherein the at least one motor is thermally coupled to the channel.

16. The apparatus of claim 12, further comprising a second heat exchanger that is thermally coupled to or forms a part of the expansion chamber.

17. The apparatus of claim 12, wherein the compressor comprises a second rotor that can rotate relative to the first rotor.

18. The apparatus of claim 12, wherein the first heat exchanger extends parallel to the axis of rotation of the first rotor.

19. The apparatus of claim 12, further comprising a motor that rotates the first rotor with respect to the frame, wherein the motor is mounted inside the first rotor and is thermally coupled to the channel.

20. The apparatus of claim 12, wherein the first heat exchanger comprises a plate heat exchanger.

21. The apparatus of claim 12, further comprising the compressible fluid, wherein the compressible fluid comprises a mono-atomic element having an atomic number (Z)≥18.

* * * * *